US006905240B2

(12) United States Patent
Yokosuka

(10) Patent No.: US 6,905,240 B2
(45) Date of Patent: Jun. 14, 2005

(54) CASE, STRAP AND TIMEPIECE

(75) Inventor: Koichi Yokosuka, Chiba (JP)

(73) Assignee: Seiko Instruments Inc., Chiba (JP)

( * ) Notice: Subject to any disclaimer, the term of this patent is extended or adjusted under 35 U.S.C. 154(b) by 105 days.

(21) Appl. No.: 10/213,259

(22) Filed: Aug. 6, 2002

(65) Prior Publication Data

US 2003/0035347 A1 Feb. 20, 2003

(30) Foreign Application Priority Data

Aug. 20, 2001 (JP) ..... 2001-249444

(51) Int. Cl.[7] ..... G04B 37/16
(52) U.S. Cl. ..... 368/282; 368/281
(58) Field of Search ..... 368/281, 282, 368/276, 283, 81, 82; 224/164, 166, 167, 177

(56) References Cited

U.S. PATENT DOCUMENTS 4,432,476 A * 2/1984 Yokosuka ..... 224/164
4,432,655 A * 2/1984 Wollman ..... 368/282
4,605,312 A * 8/1986 Sellier ..... 368/282
5,668,784 A * 9/1997 Iguchi ..... 368/282

* cited by examiner

*Primary Examiner*—Kamand Cuneo
*Assistant Examiner*—Jeanne-Marguerite Goodwin
(74) *Attorney, Agent, or Firm*—Adams & Wilks

(57) ABSTRACT

A wristwatch has a case containing a movement. The case has a strap attaching portion having a rear surface having a recessed portion. A wrist strap is attached to the case and has a case attaching portion having a rotation stop face on front surface thereof confronting the strap attaching portion of the case. The rotation stop face has a projection engageable with the recessed portion at the rear surface of the strap attaching portion to prevent rotation of the wrist strap relative to the case.

11 Claims, 2 Drawing Sheets

CASE, STRAP AND TIMEPIECE

BACKGROUND OF THE INVENTION

1. Field of the Invention

The present invention relates to a case, a strap and a timepiece combined with the case and the strap.

2. Description of the Prior Art

An explanation will be given of a conventional case, a conventional strap and a conventional timepiece in reference to the drawings. FIG. 3 is a sectional view in a state of a timepiece attaching a strap to a case. FIG. 4 is a sectional view of the case and the strap.

A conventional case 5 is provided with a strap attaching portion roof 52 for attaching a strap 6. The strap attaching portion roof 52 is provided with a strap attaching portion 51 constituting a space for bringing a portion of the strap 6 to a side of a caseback (hereinafter, referred to as 'bottom side'). Further, the strap attaching portion 51 is opened with a spring rod pin hole 55 for inserting a spring rod 3.

Further, the conventional strap 6 is provided with a spring rod hole 65 for inserting the spring rod 3 in a width direction of the strap. A periphery of the spring rod hole 65 is provided with a strap inserting face 62 for inserting to the strap attaching portion 51. Further, the strap inserting portion 62 is provided with a stepped difference such that the strap 6 is prevented from rotating when the strap 6 is attached to the case 5. Further, the strap 6 is provided with a rotation stop tongue 67 which is brought into contact also with a case back 57 to thereby prevent rotation.

Further, the conventional timepiece is assembled with the strap 6 and the case 5 by inserting the spring rod 3 into the spring rod hole 65 of the strap 6 and inserting a front end of the spring rod 3 into the spring rod pin hole 55 of the case 5.

The conventional timepiece has a problem in that when the strap attaching portion has stress applied thereto for rotating the strap in a direction of a rear face thereof, a large gap is produced at a portion of coupling the case and the strap, or the strap is rotated.

Further, in order to prevent the rotation, there is a method of setting positions of a spring rod pin hole of a case and a spring rod hole of a strap and attaching the case and the strap by a spring rod 3 constituting a connecting member in a shaft-like shape penetrating the case and the strap such that the strap is pressed to attach to the case as much as possible by utilizing elasticity of the strap. However, the method has a problem in that repulsive force produced by pressing the strap to the case is always applied to the spring rod pin hole for holding the shaft-like connecting member of the case shown in FIG. 4 respectively in a horizontal direction f1 and a vertical direction f2 and therefore, the case is deformed by the repulsive force. When the repulsive force is strong, a crack can occur. When the shape of a surrounding of the spring rod pin hole 55 is deformed, the spring rod cannot be held and the strap is detached from the case.

SUMMARY OF THE INVENTION

According to a timepiece of the invention, in a timepiece including a case formed with a strap attaching portion roof at a strap attaching portion thereof, a strap attached to the case, and a spring rod holding the strap to the case by penetrating the case and the strap, the case includes a roof rear face recessed portion formed by recessing a portion of the roof rear face of the strap attaching portion, the strap includes a rotation stop projection at a rotation stop face of the strap and prevents rotation of the strap by engaging the rotation stop projection and the roof rear face recessed portion.

The roof rear face recessed portion is formed at the roof rear face of the strap attaching portion of the case, the rotation stop projection is formed at the rotation stop face of the strap opposed to the recessed portion and the recessed portion and the projected portion are respectively engaged with each other to thereby stop rotation of the strap in view of its structure.

A band according to the invention includes a rotation stop face provided with a stepped difference from an outer shape thereof in an inner direction and the rotation stop face includes a rotation stop projection extended in a direction of the outer shape.

Further, the band according to the invention further includes a spring rod hole for inserting a connecting member to be attached to other member and the rotation stop projection is disposed upward from the spring rod hole.

A case according to the invention is a case including a strap attaching roof for attaching a strap, and a strap attaching portion for inserting the strap to a rear face of the strap attaching roof and the strap attaching portion includes a roof rear face recessed portion for stopping rotation of the strap.

Further, a timepiece according to the invention includes the strap, the case, and a connecting member for attaching the strap to the case and prevents rotation of the strap by engaging the rotation stop projection and the roof rear face recessed portion of the case with each other when the strap is assembled to the case.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

Figure 4:
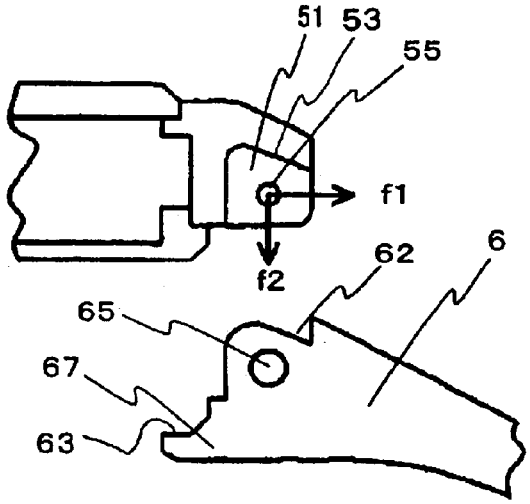
FIG. 4 PRIOR ART
FIG. 4 is a partially sectional view showing portions of a conventional timepiece and a conventional strap corresponding to the invention.

A roof rear face recessed portion 14 is formed at a roof rear face 13 of a strap attaching portion 11 of a timepiece case 1, a rotation stop projection 24 is formed at a rotation stop face 23 of a strap opposed to the recessed portion, and the recessed portion 13 and projected portion 24 are respectively engaged with each other to thereby prevent rotation of the strap. This structure eliminates the need for attaching the band to press to the timepiece case as much as possible by utilizing elasticity of the strap as a method of reducing danger of rotation and prevents stress from being applied to the spring rod pin hole 55 for holding the spring rod 3 of a shaft-like connecting member of the timepiece case, as shown in FIG. 4, in f1 and f2 directions which causes with the elapse of time, a surrounding of the spring rod pin hole 55 of the timepiece case 5 to be deformed by delayed fracture by stress applied to the synthetic resin.

EXAMPLES

Figure 1:
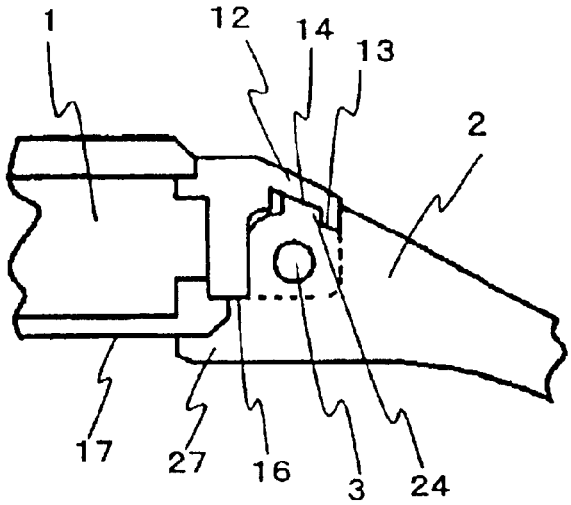
FIG. 1 is a partially sectional view showing a state of attaching a strap according to the invention.
Figure 2:
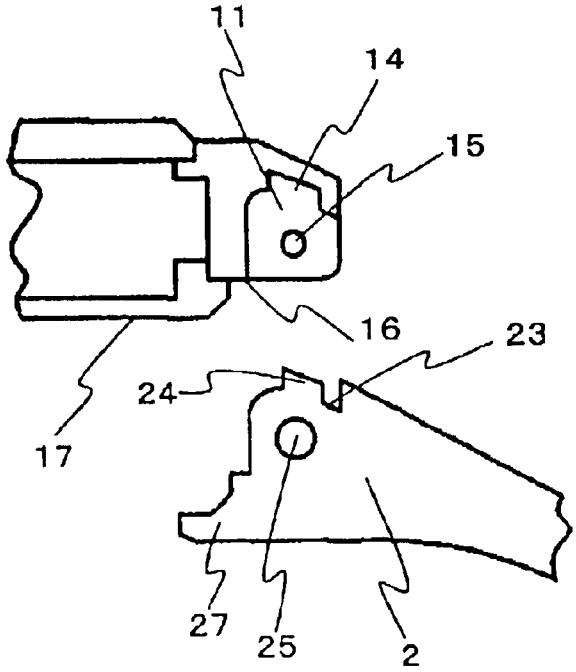
FIG. 2 is a partially sectional view showing portions of a timepiece case and a strap according to the invention corresponding to the invention.

A detailed description will be given of an embodiment of the invention in reference to FIG. 1 and FIG. 2. FIG. 1 is a sectional view showing a state of attaching a strap according to the invention and FIG. 2 is a sectional view of a timepiece case and a strap according to the invention.

According to a specific embodiment, there is formed a roof rear face recessed portion 14 at a roof rear face 13 of a strap attaching portion roof 12 constituting a strap attaching portion 11 of a timepiece case 1 of synthetic resin (generally, ABS resin). The depth of the recessed portion 14 is set to about 2 mm. A strap 2 has a case attaching portion comprised of a rotation stop face 23 on a front surface thereof. The rotation stop face 23 has a stepped shape which defines a rotation strap projection 24 to be engaged with the roof rear face recessed portion 14. The strap 2 is made of polyurethane constituting an elastic material attached to the timepiece case 1.

Figure 5:
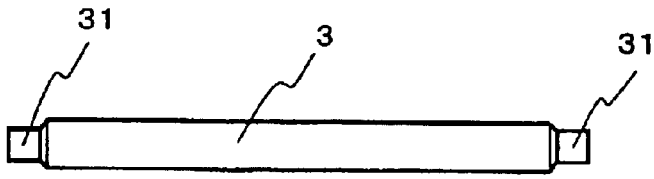
FIG. 5 shows a spring rod of a shaft-like connecting member.

The timepiece case 1 and the strap 2 constituted in this way are attached by inserting a connecting member into a spring rod hole 25 of the strap 2 and spring rod pin holes 15 of the timepiece case 1. The connecting member is preferably a spring rod 3 as shown in FIG. 5.

Figure 3:
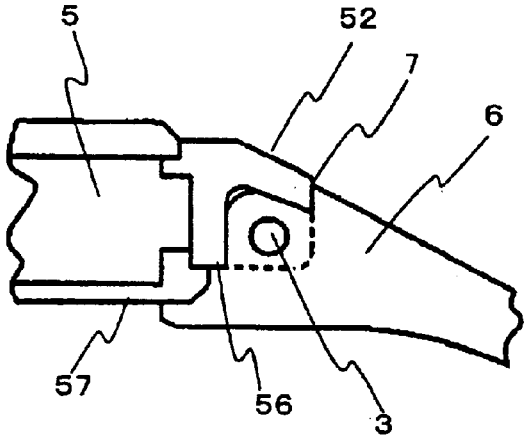
FIG. 3 PRIOR ART
FIG. 3 is a partially sectional view showing a state of attaching a conventional strap.

According to the strap attached in this way, a rotation stop tongue 27 of the strap 2 is brought into contact with a case back 17 of the timepiece case 1 to thereby assist in preventing rotation of the strap 2 and at the same time, there can be resolved the conventional problem that when applied with a stress of rotating the strap 6 in a lower direction (see FIGS. 3–4), the rotation stop face 63 of the strap 6 is elastically deformed and slid on the roof rear face 53 of the timepiece case 5 to detach from the roof rear face 53, by engaging the roof rear face recessed portion 14 of the timepiece case 1 and the rotation stop projection 24 of the strap 2.

According to the invention, rotation of the strap which is easy to rotate, can firmly be prevented and the gap produced at the portion of coupling the timepiece case and strap can be made to be very small. Further, there can be resolved stresses in the horizontal and the vertical directions generated at the spring rod pin hole for holding the shaft-like connecting member. Thereby, the spring rod pin hole can be prevented from being deformed and the strap can be prevented from being detached. Particularly, although according to a timepiece case using synthetic resin, there is also a case of causing delayed fracture by stress, by resolving the stress, the delayed fracture of the case can also be prevented.

What is claimed is:

1. A timepiece comprising: a case having a timepiece movement therein and a strap attaching portion having a roof portion; a strap attached to the strap attaching portion of the case such that the roof portion extends over a portion of the strap; and a spring rod for holding the strap to the case by penetrating through the case and the strap; wherein a rear face of the roof portion confronting the strap has a recessed portion, and the strap has a rotation stop face confronting the rear face of the roof portion and a rotation stop projection for preventing rotation of the strap relative to the case by engaging the recessed portion of the roof portion.

2. A timepiece according to claim 1; wherein the strap further comprises a rotation-preventing tongue extending under a bottom of the case for assisting in preventing rotation of the strap relative to the case.

3. A wrist strap for a timepiece, comprising: a strap having opposed front and rear surfaces and being dimensioned to extend about a user's wrist; and a case attaching portion connected to the strap for attaching the wrist strap to a case of a timepiece, the case attaching portion having a rotation stop face on a front surface thereof for preventing rotation of the wrist strap relative to the case, the rotation stop face having a stepped shape defining a rotation stop projection for projecting into a recess formed in a rear surface of the case to prevent rotation of the wrist strap relative to the case.

4. A wrist strap according to claim 3; wherein the case attaching portion is provided with a hole for inserting therethrough a connecting member to be attached to the case, the rotation stop projection being disposed frontward of the hole.

5. A wrist strap according to claim 4; further comprising a rotation-preventing tongue configured to extend under a bottom of the case when the wrist strap is attached to the case for assisting in preventing rotation of the wrist strap relative to the case.

6. A case for a timepiece, comprising: a strap attaching portion having front and rear surfaces and to which a wrist strap is attachable; and a roof portion extending from the strap attaching portion to partially cover the strap when attached to the strap attaching portion and having a rear face having a recessed portion configured to receive therein a projection on the strap to prevent rotation of the strap relative to the case.

7. A timepiece comprising: a wrist strap comprising a strap portion having opposed front and rear surfaces and being dimensioned to extend about a user's wrist, and an attaching portion connected to the strap portion and having a rotation stop face on a front surface thereof, the rotation stop face having a stepped shape defining a rotation stop projection extending outward thereof; a case having a timepiece movement disposed therein and having a strap attaching portion having front and rear surfaces and to which the wrist strap is attached, and a roof portion extending from the strap attaching portion to partially cover the wrist strap, the roof portion having a rear face provided with a recessed portion in which the rotation stop projection is engaged for preventing rotation of the strap relative to the case; and a connecting member for attaching the wrist strap to the case.

8. A timepiece according to ciaim 7; wherein the wrist strap and the case are provided with holes into which the connecting member is inserted to attach the wrist strap to the case, the rotation stop projection being disposed frontward of the holes.

9. A wristwatch comprising: a movement; a case in which the movement is disposed, the case having a strap attaching portion having a rear surface having a recessed portion; and a wrist strap attached to the case and having a strap dimensioned to extend about a user's wrist, and a case attaching portion connected to the strap and having a rotation stop face on a front surface thereof confronting the strap attaching portion of the case, the rotation stop face having a projection engageable with the recessed portion at the rear surface of the strap attaching portion to prevent rotation of the wrist strap relative to the case.

10. A wristwatch according to claim 9; wherein the case further has a roof portion extending outward therefrom to cover at least the front surface of the case attaching portion of the wrist strap, the recessed portion being formed at a rear surface of the roof portion.

11. A wristwatch according to claim 9; wherein the strap further comprises a rotation-preventing tongue extending under a bottom of the case for assisting in preventing rotation of the wrist strap relative to the case.

* * * * *